US008465568B2

(12) United States Patent
Karlsson

(10) Patent No.: US 8,465,568 B2
(45) Date of Patent: Jun. 18, 2013

(54) METHOD AND A DEVICE FOR CONTROLLING THE RAPPING OF AN ESP

(75) Inventor: Anders N. G. Karlsson, Braas (SE)

(73) Assignee: ALSTOM Technology Ltd, Baden (CH)

( * ) Notice: Subject to any disclaimer, the term of this patent is extended or adjusted under 35 U.S.C. 154(b) by 362 days.

(21) Appl. No.: 12/866,076

(22) PCT Filed: Feb. 4, 2009

(86) PCT No.: PCT/EP2009/000725

§ 371 (c)(1),
(2), (4) Date: Aug. 4, 2010

(87) PCT Pub. No.: WO2009/098032

PCT Pub. Date: Aug. 13, 2009

(65) Prior Publication Data

US 2010/0313749 A1 Dec. 16, 2010

(30) Foreign Application Priority Data

Feb. 8, 2008 (EP) ..... 08151203

(51) Int. Cl.
*B03C 3/76* (2006.01)

(52) U.S. Cl.
USPC ..... 95/2; 95/26; 95/65; 95/76; 96/18; 96/25; 96/32; 96/52

(58) Field of Classification Search
USPC ..... 95/2, 26, 76, 64, 65; 96/18, 25, 32–38, 96/52, 53
See application file for complete search history.

(56) References Cited

U.S. PATENT DOCUMENTS 3,893,828 A * 7/1975 Archer ..... 96/19
3,980,455 A * 9/1976 Masuda ..... 96/20
4,255,775 A 3/1981 Andrews (Continued)

FOREIGN PATENT DOCUMENTS

JP 49-96573 8/1974
JP 62201660 9/1987
SU 1286290 A1 * 1/1987
WO WO 97/41958 11/1997

OTHER PUBLICATIONS

PCT International Search Report and Written Opinion of the International Searching Authority dated Aug. 31, 2009 (PCT/EP2009/000725).
European Search Report dated Oct. 7, 2008.

*Primary Examiner* — Richard L Chiesa
(74) *Attorney, Agent, or Firm* — Rita D. Vacca

(57) ABSTRACT

A method of controlling operation of an electrostatic precipitator (6) is provided wherein a soot-blowing operation is performed in an upstream device. According to the method, a signal is sent to a controller (34) that a soot-blowing operation is about to be initiated in the upstream device (2). The controller (34) is operative for controlling performance of a rapping event with respect to the electrostatic precipitator (6), and causes a rapping decision (52; 152) to be made, based on receipt of the signal. The rapping decision includes establishment of a first point in time (T1) for initiating performance of a rapping event with respect to the electrostatic precipitator (6), such that said first point in time (T1) is correlated to a second point in time (T2). The second point in time (T2) is the time at which the soot-blowing operation of upstream device (2) is initiated.

12 Claims, 6 Drawing Sheets

U.S. PATENT DOCUMENTS 4,624,685 A * 11/1986 Lueckenotte et al. ..... 95/3
5,173,867 A * 12/1992 Johnston et al. ..... 700/275
5,378,978 A * 1/1995 Gallo et al. ..... 323/241
2,858,900 A1 1/2003 Foley
7,101,422 B1 * 9/2006 Altman et al. ..... 96/30
2006/0130648 A1 * 6/2006 Altman et al. ..... 95/57
2008/0000355 A1 * 1/2008 Seeley et al. ..... 96/32

* cited by examiner

METHOD AND A DEVICE FOR CONTROLLING THE RAPPING OF AN ESP

This application is a national stage of International Application No. PCT/EP2009/000725 filed on Feb. 4, 2009.

FIELD OF THE INVENTION

The present invention relates to a method of controlling the operation of an electrostatic precipitator, which is operative for removing dust particles from a process gas, with regard to a soot-blowing operation conducted in an upstream device, which is located upstream of the electrostatic precipitator with respect to the flow direction of said process gas.

The present invention further relates to a device which is operative for controlling the operation of an electrostatic precipitator.

BACKGROUND OF THE INVENTION

In the combustion of a fuel, such as coal, oil, peat, waste, etc., in a combustion plant, such as a power plant, a hot process gas is generated, such process gas containing, among other components, dust particles, sometimes referred to as fly ash. The dust particles are often removed from the process gas by means of an electrostatic precipitator, also called ESP, for instance of the type illustrated in U.S. Pat. No. 4,502,872.

A combustion plant normally comprises a boiler in which the heat of the hot process gas is utilized for generating steam. The boiler comprises internal heat transfer surfaces which become gradually fouled by dust particles of the process gas. To maintain a high heat transfer capacity the boiler is occasionally soot-blown by means of, e.g., blowing steam onto the internal heat transfer surfaces to remove the dust particles collected on the heat transfer surfaces. The removed dust particles leave the boiler together with the hot process gas. Thus, the concentration of dust particles in the hot process gas is increased during the soot-blowing procedure.

JP 62201660 in the name of Mitsubishi Heavy Industries describes a method of cleaning a hot process gas generated in a boiler. An electrostatic precipitator, ESP, is operative for removing dust particles from the hot process gas. During the soot-blowing of a gas-heater an increased amount of dust particles must be removed from the hot process gas. In accordance with JP 62201660 the ESP can operate in two different modes, a first mode, to be used during soot-blowing of the gas heater, in which first mode a power source provides maximum charge to the electrostatic precipitator, and a second mode in which the power source provides a lower charge, to be utilized between soot-blowing sequences.

While the method of JP 62201660 may in some cases decrease the amount of dust particles emitted during soot-blowing of the ESP it also results in a higher energy consumption, and requires a power source which is able to operate at a higher charging rate than what is useful in normal operation.

SUMMARY OF THE INVENTION

An object of the present invention is to provide a method by means of which the emission of dust particles caused by the soot-blowing of a boiler, a gas heater, or a similar device, can be decreased without requiring large investments and/or oversized electrostatic precipitators.

This object is achieved by a method of controlling the operation of an electrostatic precipitator, which is operative for removing dust particles from a process gas, with regard to a soot-blowing operation conducted in an upstream device, which is located upstream of the electrostatic precipitator with respect to the flow direction of said process gas, characterized in said method comprising the steps of:

effecting the sending of a signal that a soot-blowing operation is about to be initiated in said upstream device to a controller that is operative for controlling a rapping of the electrostatic precipitator, and causing a rapping decision to be made by said controller, based on the receipt thereby of said signal, said rapping decision including the establishment of a first point in time for initiating a rapping event with respect to the electrostatic precipitator, said first point in time is correlated to a second point in time, which is the time at which the soot-blowing operation of said upstream device is initiated.

An advantage of this method is that the electrostatic precipitator can be controlled for minimizing the effects of increased emission of dust particles, which will result from the soot-blowing operation. This helps to reduce the overall emission from a power plant, and reduces the problems of negative publicity linked to dust plumes that become visible from stacks during soot-blowing operations.

According to one embodiment of the present invention, said first point in time is a time which falls before said second point in time, such that the electrostatic precipitator will be at least partially cleaned from dust before the soot-blowing operation of said upstream equipment is started. An advantage of this embodiment of the present invention is that the electrostatic precipitator will have an increased capability of capturing the increased emission of dust particles caused by the following soot-blowing operation of the upstream device, a fact which will result in a substantial reduction of the emission of dust particles into the atmosphere.

According to one embodiment of the present invention, said first point in time has such a relation to said second point in time, that execution of the rapping event of the electrostatic precipitator is completed by at least 50% before the soot-blowing operation of said upstream device is initiated. An advantage of this embodiment of the present invention is that the electrostatic precipitator will already have a high capacity for capturing dust particles before the soot-blowing operation is started, such that only a part, or even none, of the rapping event has to be executed during the actual soot-blowing operation.

According to another embodiment of the present invention, the dust particles of said process gas forms a dust having a resistivity of more than 1*10E10 ohm*cm, said soot-blowing operation comprises utilizing at least one soot-blowing substance, which is selected from among steam and water, for soot-blowing said upstream device, said first point in time being controlled to fall after said second point in time, such that operation of the electrostatic precipitator is supported by an increased moisture content of the process gas. An advantage of this embodiment of the present invention is that it actively utilizes, in particular for so-called high resistivity dusts, the extra moisture content which is caused by soot-blowing with steam or water to decrease the emission of dust particles to the atmosphere. The moisture added to the process gas during the soot-blowing operation has been found to improve the removal efficiency of high resistivity dusts and this effect is actively taken into account to realize benefits in the operation of the electrostatic precipitator.

In accordance with one embodiment of the present invention, said first point in time is controlled to occur maximum 60 minutes after finalizing the soot-blowing operation, such that operation of the electrostatic precipitator is supported, during the state just before the cleaning of the electrostatic precipitator by executing a rapping event, with an increased moisture content of the process gas. An advantage of this embodiment of the present invention is that the increased emission of dust particles during rapping events of an electrostatic precipitator, an effect which is particularly severe in electrostatic precipitators that are operative for removing dust particles of a high resistivity, is alleviated by starting a rapping event in conjunction with a soot-blowing operation, during which the re-entrainment of dust is decreased, possibly because the resistivity of the dust is decreased by the added moisture.

According to one embodiment of the present invention, said first point in time is controlled to occur during the soot-blowing operation, such that operation of the electrostatic precipitator is supported, during the execution of the rapping event, by an increased moisture content of the process gas. An advantage of this embodiment of the present invention is that the rapping event is performed during the actual soot-blowing operation, i.e., when the moisture content of the process gas is high and the resistivity of the dust is low, such that the re-entrainment of dust particles during said rapping event is decreased.

According to another embodiment of the present invention, said first point in time is controlled to occur 0-5 minutes after the soot-blowing operation is completed. An advantage of this embodiment of the present invention is that the dust particles already available on the collecting electrode plates of the electrostatic precipitator appear to form more solid dust cakes during the soot-blowing operation, the latter resulting in increased moisture content of the process gas. Thus, by starting a rapping event just after the soot-blowing operation the dust particles will come off the collecting electrode plates of the electrostatic precipitator in a more dense form, causing less re-entrainment of dust particles during the rapping event.

According to one embodiment of the present invention, said controller notifies a soot-blowing controller about the rapping status of the electrostatic precipitator, with the soot-blowing controller then setting said second point in time with respect to said rapping status. An advantage of this embodiment of the present invention is that the soot-blowing controller is informed about the rapping status, e.g., if the rapping event is in progress or if the rapping event has been finalized. In view of this information the soot-blowing controller can set the second point in time to a suitable value, such that the emission of dust particles can be kept to the lowest possible level.

According to one embodiment of the present invention, said information to the effect that a soot-blowing operation is about to be started in said upstream device also contains information concerning what type of soot-blowing operation is about to be started. An advantage of this embodiment of the present invention is that the rapping controller may control the rapping events that are to be conducted in view of the conditions with respect to, e.g., the amount of dust particles, the moisture content, etc., that will be caused by the type of soot-blowing operation that is to be conducted, and with respect to the duration of the type of soot-blowing operation that is to be conducted.

A further object of the present invention is to provide a device which is operative for controlling the rapping of an electrostatic precipitator in such a manner that the emission of dust particles caused by the soot-blowing of a boiler, a gas heater, or a similar device, can be decreased without requiring large investments and/or over-sized electrostatic precipitators.

This object is achieved by means of a device for controlling the operation of an electrostatic precipitator, which is operative for removing dust particles from a process gas, with regard to a soot-blowing operation conducted in an upstream device, which is located upstream of the electrostatic precipitator with respect to the flow direction of said process gas, characterized in said device comprising a controller which is operative for controlling the performance of a rapping event with respect to the electrostatic precipitator and for receiving a signal to the effect that a soot-blowing operation is about to be initiated in said upstream device, said controller further being operative for causing a rapping decision, based on the receipt thereby of said signal, said rapping decision including the establishment of a first point in time for initiating the performance of a rapping event with respect to the electrostatic precipitator, such that said first point in time is correlated to a second point in time, which is the time at which the soot-blowing operation of said upstream device is initiated.

An advantage of this device is that it provides for the efficient control of the rapping of an electrostatic precipitator, such that the emission of dust particles caused by the rapping of the collecting electrode plates of said electrostatic precipitator and by the soot-blowing operations of said upstream device can be minimized. Since a standard electrostatic precipitator can be utilized in this regard, the investment cost to do so is limited to that of the device comprising the rapping controller. In some cases, when utilizing the device of the present invention for controlling the operation of the electrostatic precipitator, it may even be possible to design a smaller electrostatic precipitator, having, e.g., fewer and/or smaller collecting electrode plates, and/or fewer fields, when compared to the prior art.

According to one embodiment of the present invention, said controller is operative for starting a rapping event at said first point in time that is a time, which falls before said second point in time, such that the electrostatic precipitator will be at least partially cleansed of dust before the soot-blowing operation of said upstream equipment is started. An advantage of this embodiment of the present invention is that the device is operative for purposes of the electrostatic precipitator receiving the increased amount of dust particles that will be created by the later soot-blowing operation that will be started at said second point in time.

According to another embodiment of the present invention, said soot-blowing operation involves the utilization of steam and/or water, and with said controller being operative for purposes of selecting said first point in time so that said first point in time falls after said second point in time, such that the operation of the electrostatic precipitator, wherein the electrostatic precipitator is operative for purposes of removing a high resistivity dust, is supported in that the process gas has an increased moisture content. An advantage of this embodiment of the present invention is that the soot-blowing operation, which has been found to decrease the resistivity of the dust, is capable of being utilized for the purpose of increasing the dust particle removal efficiency of the electrostatic precipitator in conjunction in particular with the rapping of the collecting electrode plates of the electrostatic precipitator.

Further objects and features of the present invention will be apparent from the description and the claims.

BRIEF DESCRIPTION OF THE DRAWINGS

The invention will now be described in more detail with reference to the appended drawings in which.

DESCRIPTION OF PREFERRED EMBODIMENTS

Figure 1:
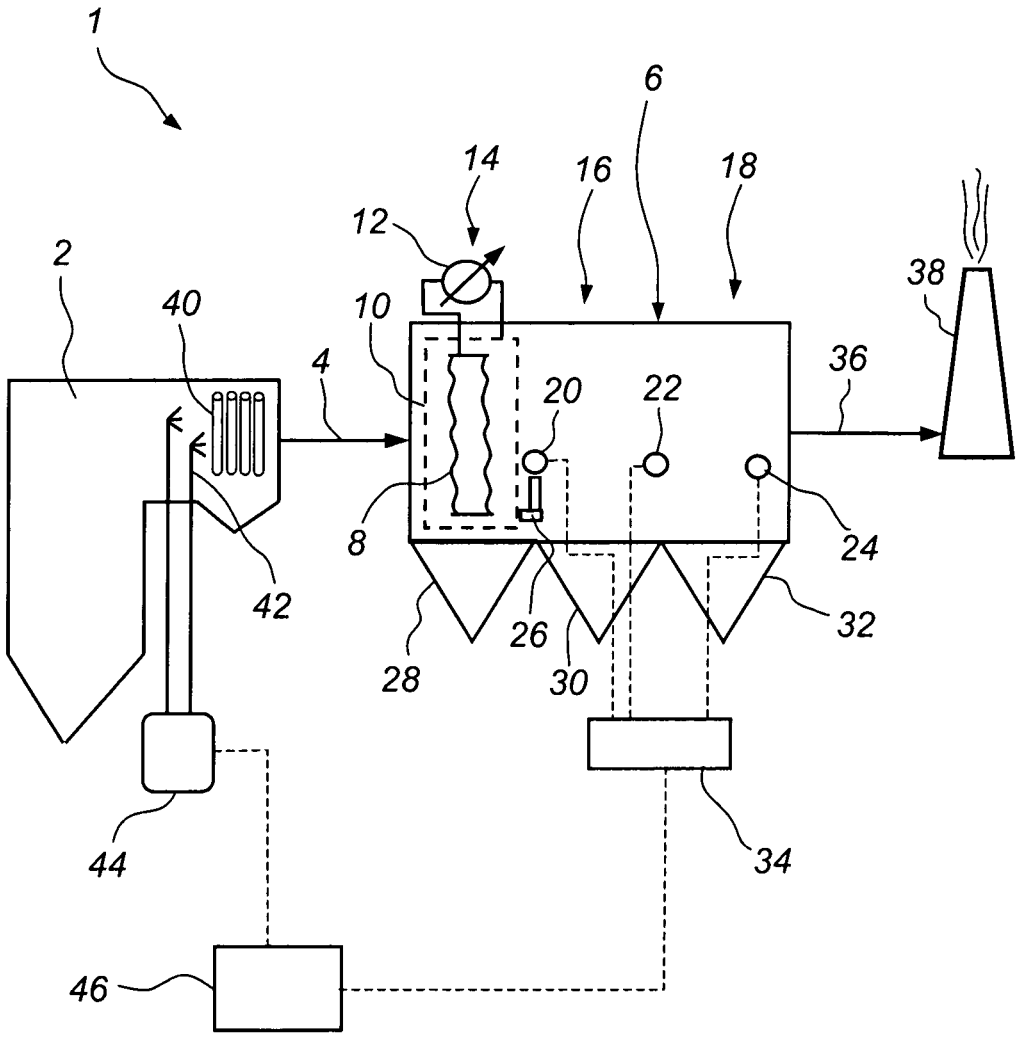
FIG. 1 is a schematic side view of a power plant in accordance with one embodiment of the present invention.

FIG. 1 is a schematic side view and illustrates a power plant 1, as seen from the side thereof. The power plant 1 comprises a coal fired boiler 2. In the coal fired boiler 2 coal is combusted in the presence of air generating a hot process gas in the form of so-called flue gas that leaves the coal fired boiler 2 via a duct 4. The flue gas generated in the coal fired boiler 2 comprises dust particles, that must be removed from the flue gas before the flue gas can be emitted to the ambient air. The duct 4 conveys the flue gas to an electrostatic precipitator, ESP, 6 which with respect to the flow direction of the flue gas is located downstream of the boiler 2. The ESP 6 comprises several discharge electrodes, of which only one discharge electrode 8 is shown in FIG. 1, and several collecting electrode plates, of which only one collecting electrode plate 10 is shown in FIG. 1. A power source 12 is operative for applying a voltage between the discharge electrodes 8 and the collecting electrode plates 10 to charge the dust particles that are present in the flue gas. After being so charged, the dust particles are collected on the collecting electrode plates 10. The discharge electrodes 8 and the collecting electrode plates 10 of the ESP 6 are preferably divided into several of what are commonly referred to as fields, each of which comprises a power source 12 that is operative for purposes of applying a voltage between the discharge electrodes 8 and the collecting electrode plates 10 of the specific field with which they are associated. In FIG. 1, only a first field 14, in the interest of maintaining clarity of illustration therein, has been shown in detail. However, preferably the ESP 6 comprises also a second field 16 and a third field 18, each of which with respect to the direction of the flue gas flow, is located downstream of the first field 14. Each of the second and third fields 16, 18, respectively, comprises a power source, discharge electrodes and collecting electrode plates of similar design and arranged in essentially the same manner as those of the first field 14, which have been described hereinbefore and which are illustrated in FIG. 1 of the drawing.

Occasionally it is necessary to clean the collecting electrode plates 10 of each of the respective ones of the fields 14, 16, 18. To this end each of the fields 14, 16, 18 is provided with a rapping device 20, 22, 24, respectively. Each of the rapping devices 20, 22, 24 is designed to be operative to effect the cleaning of the collecting electrode plates 10, by means of rapping them, of the respective one of the fields 14, 16, 18 in question. The rapping device 20 comprises, as illustrated in FIG. 1, a set of hammers, of which only one hammer 26, in the interest of maintaining clarity of illustration therein, is illustrated in FIG. 1. A more thorough description of one example of how such hammers might be designed can be found in U.S. Pat. No. 4,526,591. Other types of rapping devices can also be utilized, for instance, so-called magnetic impulse gravity impact rappers, also known as MIGI-rappers might also be employed for this purpose. The hammers 26 are designed to be operative to impact the collecting electrode plates 10, such that the dust particles collected therein are caused to be released from the collecting electrode plates 10 and as such can then be collected in the appropriate one of the hoppers 28, 30, 32, which are located beneath each of the respective one of the fields 14, 16, 18. The operation of the rapping devices 20, 22, 24 is designed to be controlled by means of a rapping controller 34. For example, the rapping controller 34 would normally cause each of the rapping devices 20, 22, 24 to initiate a rapping event of the collecting electrode plates 10 of the respective one of the fields 14, 16, 18 in accordance with a pre-established time sequence. For instance, the collecting electrode plates 10 of the first field 14, in which normally most of the dust particles are collected, may be rapped, e.g., every 30 minutes, while the collecting electrode plates of the second field 16 may be rapped, e.g., every 60 minutes, and lastly the collecting electrode plates of the third field 16 may be rapped, e.g., every 10 hours.

A duct 36 is provided that is designed to be operative to transmit flue gas, from which at least part of the dust particles have been removed, to a stack 38 from the ESP 6. From the stack 38, the flue gas is then released to the atmosphere.

The boiler 2 comprises internal heat transfer surfaces, schematically illustrated at 40 in FIG. 1, which are designed to be operative to absorb heat from the flue gas and to transfer this heat to the water that is flowing in a manner well-known in the art in the heat transfer surfaces 40 of the boiler 2 to thereby produce high-pressure steam. The combustion of the coal in the boiler 2 generates dust particles, which will be deposited at least partly on the heat transfer surfaces 40. Soot-blowing lances, schematically illustrated at 42 in FIG. 1, are provided for the purpose of cleaning occasionally the heat transfer surfaces 40 of the boiler 2. The soot-blowing lances 42 are preferably connected in a known manner to a high pressure steam source 44, which is designed to be operative under the control of a soot-blowing controller 46. When steam is supplied from the steam source 44 to the soot-blowing lances 42, the soot-blowing lances 42 are operative to spray this steam onto the heat transfer surfaces 40, such that the dust particles that have been deposited on the heat transfer surfaces 40 are removed therefrom by the steam. A complete soot-blowing operation may last, e.g., 10 minutes and is designed to be initiated when the heat transfer surfaces 40 have become fouled by virtue of the deposition thereon of dust particles. One possibility of detecting that it is time for initiating a soot-blowing operation is that the steam production has decreased.

When it is determined that the heat transfer surfaces 40 need to be cleaned, the soot-blowing controller 46 becomes operative to prepare for effecting the initiation of a soot-blowing operation. To this end, before effecting the initiation of the soot-blowing operation, the soot-blowing controller 46 causes a signal to be sent to the rapping controller 34 indicating that a soot-blowing operation will soon be initiated. Based on the receipt thereby of this signal, the rapping controller 34 becomes operative to initiate a rapping decision, whereby there is established a first point in time when a rapping event of at least one of the fields 14, 16, 18 is to be initiated. The purpose of causing this rapping decision to be made is to prepare the ESP 6 for the soot-blowing operation, which will be initiated at a second point in time. A couple of types of different rapping decisions will be described in detail below, with reference in particular to FIGS. 3*a*-3*c* and FIGS. 4*a*-4*c* of the drawings. The rapping controller 34 and soot-blowing controller 46 may each include, for example, a microprocessor, application specific integrated circuit (ASIC), digital signal processor (DSP), analog circuit or other device capable of executing machine-readable instructions. The machine-readable instructions configure the controllers 34 and/or 46 to perform the functions described herein.

Figure 2:
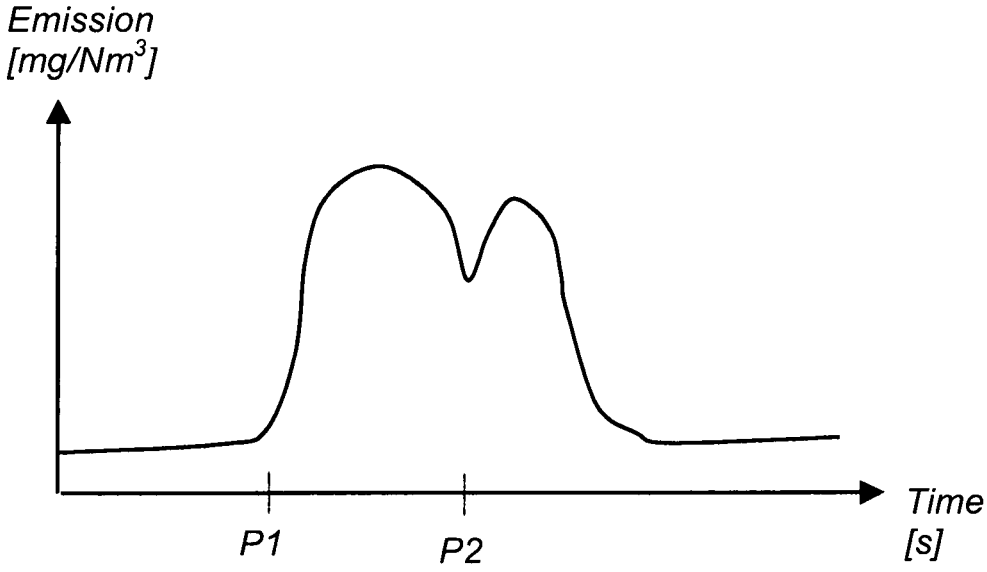
Prior art Fig. 2
FIG. 2 is a schematic diagram illustrating the emission of dust particles produced by a method in accordance with the prior art.

In FIG. 2 of the drawings there is illustrated a diagram that depicts the effect of operating a power plant in accordance with a prior art method. For purposes of FIG. 2, this prior art method is deemed to be applied to a power plant having a boiler, soot-blowing equipment, an ESP, and a stack that are arranged so as to be operative in a manner similar to that which has been described hereinbefore with reference to FIG. 1. However, the control of the soot-blowing of the boiler and of the rapping of the ESP in accordance with this prior art method are different from that of the invention to which the present application is directed. Referring further to FIG. 2 of the drawings, the x-axis of the diagram depicted therein illustrates time, in seconds, and the y-axis of the diagram depicted therein illustrates the emission of dust particles to the ambient air, i.e., the concentration of dust particles that is present in the flue gas leaving the stack, in mg of dust particles per $Nm^3$ of flue gas.

In accordance with the prior art method to which the diagram in FIG. 2 is applicable, a soot-blowing operation is initiated at the time P1. This soot-blowing operation causes large amounts of the dust particles that have been deposited on the heat transfer surfaces of the boiler to be released therefrom, and some of these dust particles become entrained in the flue gas. The increased amount of dust particles in the flue gas that flows to the ESP results in the ESP receiving an overload of dust particles, which is difficult for the ESP to handle. To this end, as can be seen with reference to FIG. 2, there is a high peak produced in the emission of dust particles just after the time P1. The controller of the ESP, in accordance with the mode of operation of the prior art method to which the diagram of FIG. 2 is applicable, is designed to react to this increased load of dust particles in the flue gas resulting from the soot-blowing operation, and initiates, at the time P2, a rapping event of some, if not all, of the fields of the ESP. Such rapping of the collecting electrode plates of the ESP, in accordance with the mode of operation of the prior art method, generally causes an increased emission of dust particles, since some of the dust particles collected on the collecting electrode plates become re-entrained in the flue gas during the rapping event. In accordance with the mode of operation of the prior art method to which the diagram illustrated in FIG. 2 is applicable, the collecting electrode plates of the ESP become overfilled with dust particles as a result of the aforementioned soot-blowing operation, which means that the emission of dust particles produced by the aforementioned rapping event will be substantially larger than during a "normal" rapping event. As can be seen with reference to FIG. 2, the aforementioned rapping of the ESP results in the creation of a second peak in the emission of dust particles, just after the time P2. Thus, as best understood with reference to FIG. 2, operating in accordance with the prior art method to which the diagram of FIG. 2 is applicable results in the creation of two high dust particle emission peaks; namely, one when the soot-blowing operation is initiated, and one when the ESP is rapped due to the existence of an overload of dust particles on the collecting electrode plates of the ESP. It will be readily appreciated that two such large dust particle emission peaks can produce severe problems insofar as being able to meet the dust emission standards, which have been set by the regulatory authorities, and may even result in the creation of a black plume of dust particles that is visible leaving from the stack.

Figure 3A:
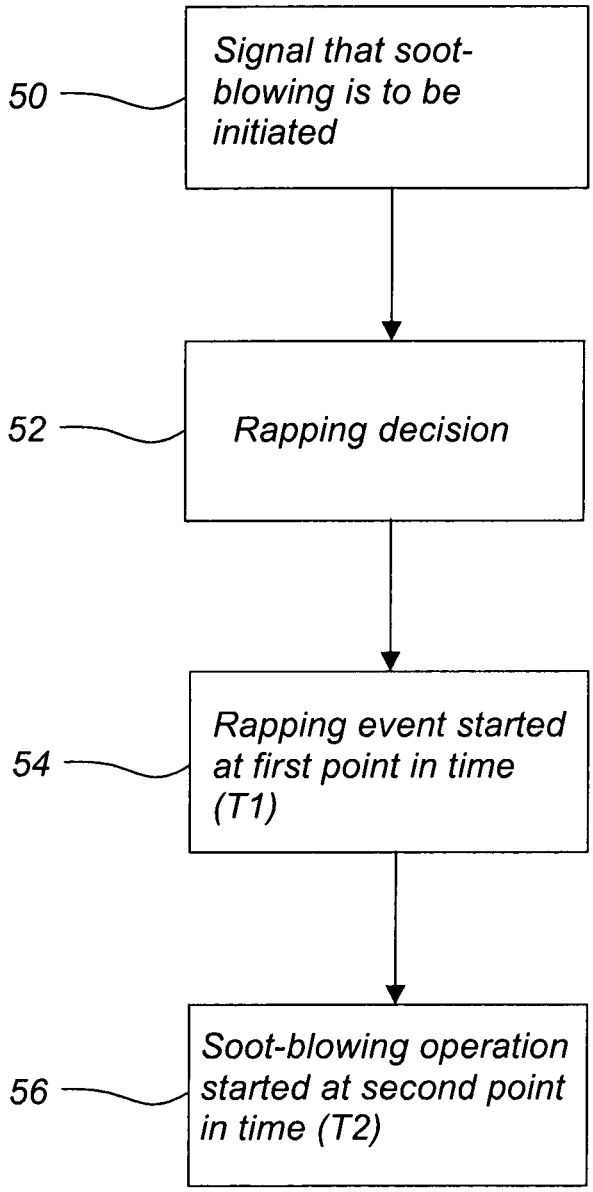
FIG. 3*a* is a flow-diagram illustrating a first method of controlling an electrostatic precipitator in accordance with the present invention.

FIG. 3*a* is a flow diagram and illustrates the steps of a first method in accordance with the present invention of controlling the operation of the ESP 6 of FIG. 1. In accordance therewith, as a first step, the latter being illustrated as 50 in FIG. 3*a*, the soot-blowing controller 46, which is illustrated in FIG. 1, causes a signal to be sent to the rapping controller 34, which signal indicates that a soot-blowing operation is about to initiated in, e.g., 15 minutes. In response to the receipt thereof of this signal, the rapping controller 34 is operative, in a second step, the latter being illustrated as 52 in FIG. 3*a*, to initiate a rapping decision. This rapping decision includes a consideration of whether the collecting electrode plates 10 of one or more of the three fields 14, 16, 18 of the ESP 6 need to be rapped prior to the initiation of the aforementioned soot-blowing operation, in view of the large amount of dust particles that will be produced by the aforementioned soot-blowing operation. In the event that one or more of the fields 14, 16, 18 of the ESP 6 need to be rapped prior to the initiation of the soot-blowing operation, the rapping controller 34 is operative to establish in the rapping decision a first point in time T1, when a rapping event must be initiated for said one or more of the fields 14, 16, 18 of the ESP 6. It will be readily appreciated that such first point in time T1 could be made to occur "immediately", i.e., that the rapping controller 34 by said rapping decision could cause the respective rapping device 20, 22, 24 of said one or more of the fields 14, 16, 18 to immediately start a rapping event. It is also possible that such first point in time T1 could equally well without departing from the essence of the present invention be made to be a time, which would occur several minutes in the future, e.g., 1 to 10 minutes from the time the rapping decision is made. In any event, in accordance with the method of the present invention as best understood with reference to FIG. 3*a* of the drawings, the first point in time T1, which is the point in time at which the rapping event is initiated, occurs before a second point in time T2, which is the point in time at which the soot-blowing operation is initiated, as established by the soot-blowing controller 46. Hence, in accordance with this method of the present invention, the rapping controller 34 initiates in a third step, which is illustrated as 54 in FIG. 3*a*, and at the first point in time T1, rapping events in those fields 14, 16, 18 of the ESP 6 where a need exists for rapping prior to the initiation of the aforementioned soot-blowing operation. As described hereinbefore, the first point in time T1 is selected such that any rapping events that are needed are made to occur before the aforementioned soot-blowing operation is initiated. By virtue of this, the ESP 6 will thus be caused to be as clean as possible before the aforementioned soot-blowing operation is initiated. Accordingly, the ESP 6 will be in a good condition insofar as concerns the handling of the large amount of dust particles that are released during the aforementioned soot-blowing operation, the latter operation being initiated in a fourth step, which is illustrated as 56 in FIG. 3*a*, at said second point in time T2. It will be readily appreciated that the normal rapping times of the fields 14, 16, 18 of the ESP 6, as described hereinbefore with reference to FIG. 1, are subject to being overruled by the information that is produced from the soot-blowing controller 46 to the effect that a soot-blowing operation is about to be initiated. Hence, after such information, which is produced by the soot-blowing controller 46, is received by the rapping controller 34, the rapping controller 34 functions in accordance with the flow diagram of FIG. 3*a*, effectively thereby negating any consideration insofar as the times at which rapping of the fields 14, 16, 18 of the ESP 6 occurs under normal operation is concerned.

Figure 3B:
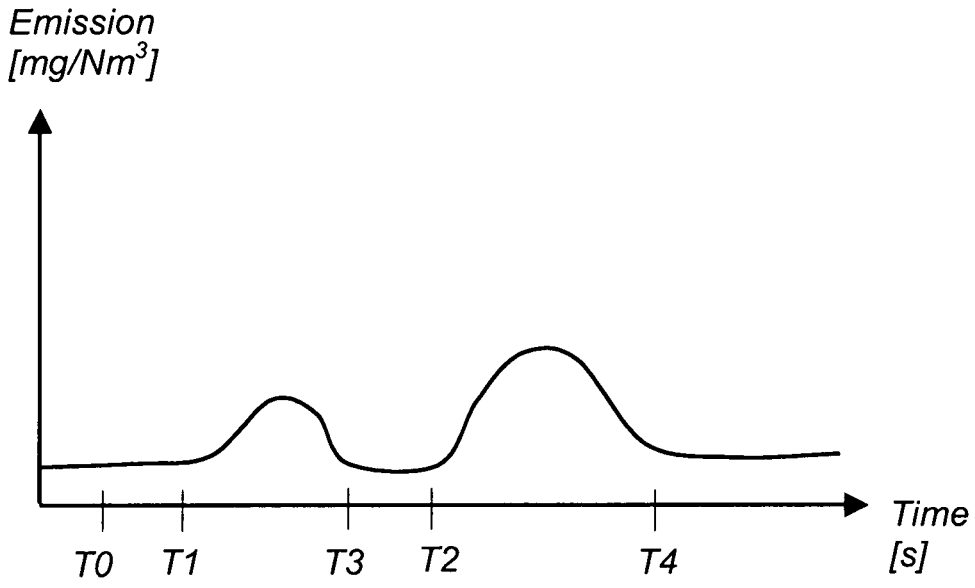
FIG. 3*b* is a schematic diagram illustrating the emission of dust particles produced by operating in accordance with the first method of the present invention.

Referring now to FIG. 3*b* of the drawings, there is illustrated therein a schematic diagram depicting the manner in which the first method of the present invention operates, with the function and the results produced by operation of the first method of the present invention being described hereinafter in more detail. To this end, at a time T0, identified as T0 in FIG. 3*b*, the soot-blowing controller 46 is operative to send a signal to the rapping controller 34 to the effect that a soot-blowing operation in the boiler 2 is to be initiated in the near future, e.g., in about 15 minutes. In response to the receipt thereby of this signal, the rapping controller 34 causes a check to be effected of the rapping status of each of the three fields 14, 16, 18 of the ESP 6, which are illustrated in FIG. 1. Inasmuch as it is contemplated that the forthcoming soot-blowing operation will produce a substantial increase in the concentration of dust particles that become entrained in the flue gas, the rapping controller 34 is designed to be operative to ensure that the collecting electrode plates 10 of each of the fields 14, 16, 18 of the ESP 6 are essentially more or less completely clean. Thus, the rapping controller 34 is designed to be operative to issue, when this is deemed to be necessary, a rapping decision to the effect that one or more or all three fields 14, 16, 18 of the ESP 6 are to be subjected to rapping prior to the initiation of the soot-blowing operation at the time T2. The rapping controller 34 operates to cause the rapping devices 20, 22, 24 to initiate rapping events with respect to the fields 14, 16, 18 of the ESP 6 in accordance with a prescribed schedule. By rapping only one, or two, of the three fields 14, 16, 18 of the ESP 6 at the same time, the remaining ones of the fields 14, 16, 18, which are not rapped, are operative to capture some of the dust particles that are released during the rapping events of the other ones of the fields 14, 16, 18 of the ESP 6. For example, the rapping controller 34 might first send a signal, at a first point in time T1, to the rapping device 24 of the third field 18 of the ESP 6 to initiate a rapping event with respect thereto. When this rapping event of the third field 18 has been completed, typically after 1-4 minutes, the rapping controller 34 might then send a signal to the rapping device 22 of the second field 16 to initiate a rapping event with respect thereto. After this rapping event of the second field 16 has been completed, again typically after about 1-4 minutes, the rapping controller 34 might thereafter send a signal to the rapping device 20 of the first field 14 to initiate a rapping event with respect thereto, which will then be completed typically after 1-4 minutes. Thus, as best understood with reference to FIG. 3*b* of the drawings, beginning at the first point in time T1 and ending at the time T3, that is, after about 5-15 minutes, the collecting electrode plates 10 of all three fields 14, 16, 18 of the ESP 6 will have been rapped and the ESP 6 can then be deemed to be clean. With further reference to FIG. 3*b*, the rapping events that take place relative to the ESP 6 result in an increased emission of dust particles, as measured in terms of the unit mg of dust particles per $Nm^3$ of flue gas leaving the stack 38, during the period, which begins at said first point in time T1 and which ends at the time T3. However, the increase in the emission of dust particles during that time period, i.e., beginning at the time T1 and ending at the time T3, is rather moderate, due to the fact that the collecting electrode plates 10 of the fields 14, 16, 18 of the ESP 6 are rapped both in a controlled order and before they can become overfilled with dust particles. Thus, when the soot-blowing operation is initiated by the soot-blowing controller 46 at the second point in time, T2, which typically occurs 0-5 minutes, and more preferably 0-2 minutes, after the time T3, the ESP 6 is in a good condition insofar as its ability to receive the dust particles released during the soot-blowing operation is concerned. The soot-blowing operation, which is initiated at the second point in time T2 and is completed at the time T4, results in an increased emission of dust particles, as will be readily apparent from a reference to FIG. 3*b*. As such, because the ESP 6 is rapped prior to initiating the soot-blowing operation, the emission of dust particles in the case of the first method of the present invention is much smaller than that produced in the operation of the prior art method, to which reference has been made in connection with the discussion hereinbefore of FIG. 2. Thus, said first method of the present invention, which has been described hereinbefore with reference to FIG. 3*a* and FIG. 3*b*, results in a substantial decrease in the emission of dust particles as compared to that produced through the use of the prior art method to which reference has been made in connection with the discussion hereinbefore of the diagram that is depicted in FIG. 2 of the drawings.

It has been described hereinbefore, with reference to the discussion of FIG. 3*b* of the drawings, that the rapping events of all of the fields 14, 16, 18 of the ESP 6 have been completed at the time T3, which as shown in FIG. 3*b* occurs before the second point in time T2. An alternative embodiment of this first method of the present invention is to have the rapping controller 34 be operative for purposes of sending a signal to the soot-blowing controller 46 indicating that all rapping events have been completed and that the soot-blowing operation may be initiated. In response to the receipt thereby of such a signal, the soot-blowing controller 46 could be made to be operative to cause the second point in time T2 to occur immediately after the time T3 thereby thus causing the soot-blowing operation to be initiated immediately after the rapping events have been completed. Hence, in accordance with this alternative embodiment of the present invention, the soot-blowing controller 46 could be made to be operative to first send a signal to the rapping controller 34 indicating thereto that a soot-blowing operation need to be initiated in the near future and that rapping of the ESP 6 may be required, and as such that the soot-blowing controller 46 should then wait for a signal from the rapping controller 34 to the effect that any rapping events that needed to take place have now been completed, before the soot-blowing controller 46 actually causes the initiation, at said second point in time T2, of any such soot-blowing operation.

Figure 3C:
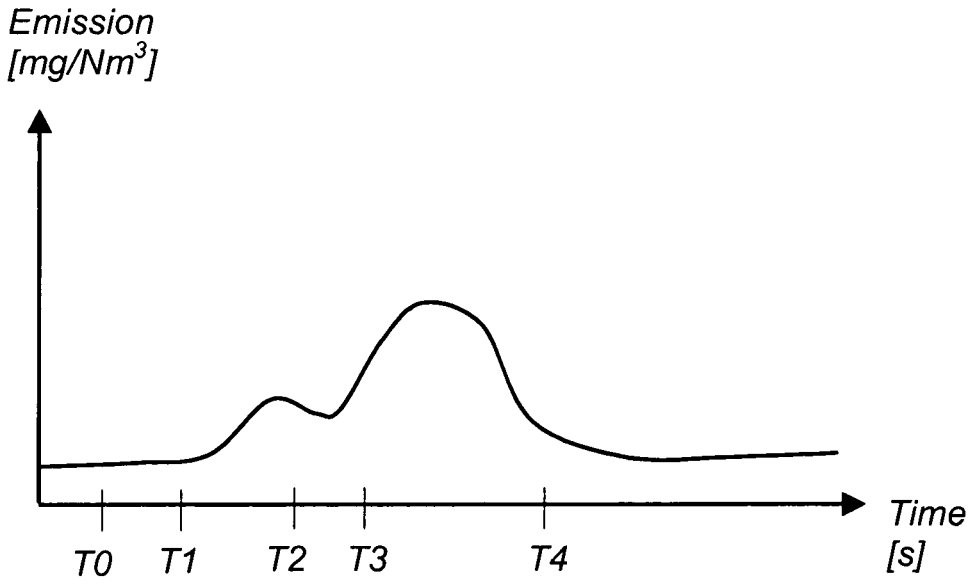
FIG. 3*c* is a schematic diagram illustrating the emission of dust particles produced by operating in accordance with an alternative first method of the present invention.

FIG. 3*c* illustrates another alternative embodiment of the first method of the present invention that is illustrated in FIG. 3*a*. In accordance with this another alternative embodiment of the first method of the present invention, the soot-blowing operation may be initiated before the rapping events have been completed. To this end, with reference to FIG. 3*c*, the soot-blowing controller 46 is made to send a signal at time T0 indicating that a soot-blowing operation is about to be initiated. In response to the receipt thereby of this signal, the rapping controller 34 causes a rapping decision to be made, which rapping decision may be similar to that described hereinbefore with reference to the discussion relative to FIG. 3*b*, and a rapping event is thus initiated at a first point in time T1. Then, in accordance with this another alternative embodiment of the first method of the present invention, the soot-blowing controller 46 initiates the soot-blowing operation at a second point in time T2, which occurs after said first point in time T1, but before the time T3 at which all of the rapping events have been completed. Hence, as best understood with reference to FIG. 3*c*, the aforementioned soot-blowing operation is initiated before all of the rapping events have been completed. The another alternative embodiment of the first method of the present invention to which FIG. 3*c* is directed often results in a slightly higher emission of dust particles than does that of the embodiment of the first method of the present invention to which FIG. 3*b* is directed, but, on the other hand, the total time for the rapping events and the soot-blowing operation to be completed, i.e., the time frame beginning at time T1 and ending at time T4, is shorter than that of the embodiment of the first method of the present invention to which FIG. 3*b* is directed. Preferably, the second point in time T2 should, in any event, be chosen such that the rapping events of the ESP 6 have been at least 50% completed, and preferably at least 70% completed. To this end, if the time span beginning from the first point in time T1 and ending at the time T3 during which all of the rapping events have been completed is 10 minutes, then the second point in time T2 should occur not less than 5 minutes after the time T1, and more preferably not less than 7 minutes after the time T1.

Therefore, in accordance with the first method of the present invention to which FIG. 3*a*, FIG. 3*b*, and FIG. 3*c* are each directed, the first point in time T1, being the point in time at which the rapping events are initiated, occurs before the second point in time T2, the latter being the point in time at which the soot-blowing operation is initiated. The second point in time T2 should, preferably, occur no more than maximum 60 minutes, more preferably maximum 10 minutes, and most preferably maximum 5 minutes, after the time T3, which is the point in time at which the rapping events have been completed, because otherwise the collecting electrode plates 10 of the ESP 6 may once again become coated with dust particles that have been captured thereby from the flue gas. The second point time T2, without departing from the essence of the present invention, may also, as best understood with reference to FIG. 3*c*, be made to occur shortly before the time T3.

Figure 4A:
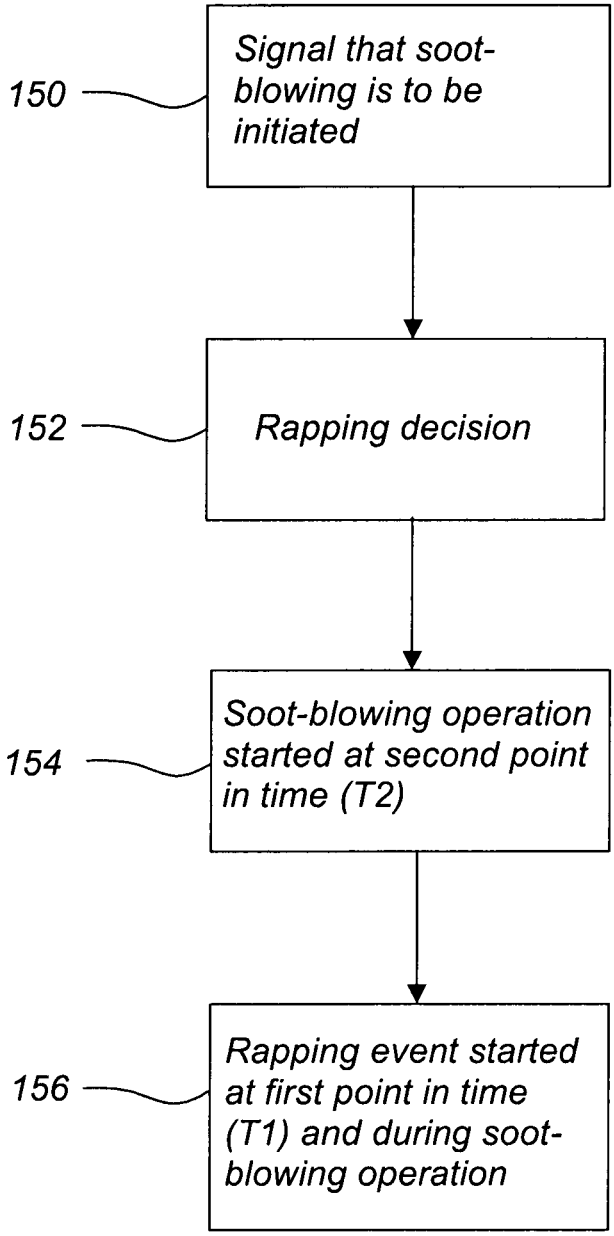
FIG. 4*a* is a flow-diagram illustrating a second method of controlling an electrostatic precipitator in accordance with the present invention.

FIG. 4*a* is a flow diagram wherein there is illustrated the steps of a second method of the present invention of controlling the operation of the ESP 6 of FIG. 1 in accordance with the present invention. This second method of the present invention is particularly suitable for use in the case wherein the ESP 6 is designed to be operative to effect the collection therewith of so-called high resistivity dust. By "high resistivity dust", as this term is employed in this application, is meant that the dust particles of the flue gas form a dust having a resistivity of more than 1*10E10 ohm*cm, as measured in accordance with IEEE Std 548-1984: "IEEE Standard Criteria and Guidelines for the Laboratory Measurement and Reporting of Fly Ash Resistivity", of The Institute of Electrical and Electronics Engineers, Inc, New York, USA. Such high resisitivity dust is difficult for the ESP 6 to collect by virtue of the fact that the charging of the dust particles through the use of the discharge electrodes 8 and of the collecting electrode plates 10 is not very efficient. However, it has now been found that if the soot-blowing operation is performed through the use of the supplying of steam, i.e., high pressure water vapour, or water, the soot-blowing operation may even improve the operation of the ESP 6 in the case where the ESP 6 is being employed for purposes of collecting high resistivity dust. The reason for the increased removal efficiency is believed to be that the water vapour that is added to the flue gas during the soot-blowing operation decreases the resistivity of the dust, thereby making the particles of dust easier to be collected by the ESP 6. Often the most critical period of the operation of an ESP 6 is the rapping events, since, as has been described hereinbefore, some of the dust particles collected on the collecting electrode plates 10 many times tend to become re-entrained in the flue gas during the rapping events. With a high resistivity dust the problems of re-entrainment during rapping events are even greater than with low resistivity dusts. Hence, in accordance with a first embodiment of the second method of the present invention to which each of FIGS. 4*a* and 4*b* is directed, the rapping events are controlled so as to be made to occur during the soot-blowing operation, since by doing so it has been found that the emission of dust particles is reduced.

In a first step, which is illustrated at 150 in FIG. 4*a*, of said second method of the present invention, the soot-blowing controller 46, to which reference has been made hereinbefore in connection with the discussion relative to FIG. 1, causes a signal to be sent to the rapping controller 34 indicating thereto that a soot-blowing operation is to be initiated in, e.g., 15 minutes. In response to the receipt thereby of this signal, the rapping controller 34, in a second step, which is illustrated at 152 in FIG. 4*a*, causes a rapping decision to be made. This rapping decision encompasses a consideration of whether the collecting electrode plates 10 of one or more of the three fields 14, 16, 18 of the ESP 6 should be rapped during the soot-blowing operation, in view of the fact that there will be a decreased resistivity of the dust particles during the soot-blowing operation. In the event that it should be determined that one or more of the fields 14, 16, 18 of the ESP 6 need to be rapped during the soot-blowing operation, the rapping controller 34 will cause there to be established in the rapping decision a first point in time T1, at which a rapping event must be initiated for at least one of the fields 14, 16, 18 of the ESP 6. In any event, in accordance with the second method of the present invention, as will be best understood with reference to FIG. 4*a*, the first point in time T1, being the time at which a rapping event is initiated, occurs after a second point in time T2, which is the time at which the soot-blowing operation is initiated that is set by the soot-blowing controller 46. Hence, in accordance with this second method of the present invention, the soot-blowing controller 46 initiates in a third step, which is illustrated at 154 in FIG. 4*a*, a soot-blowing operation at said second point in time T2. In a fourth step of the second method of the present invention, which is illustrated at 156 in FIG. 4*a*, the rapping controller 34 initiates, at said first point in time T1 and before the soot-blowing operation has been completed, the rapping events of the fields 14, 16, 18 of the ESP 6. It will be appreciated that without departing from the essence of the present invention, a similar sequence of starting rapping events of the fields 14, 16, 18 of the ESP 6 as that which has been described hereinbefore with reference to the discussion in connection with the FIG. 3*b* could equally well also be utilized in this second method of the present invention.

Figure 4B:
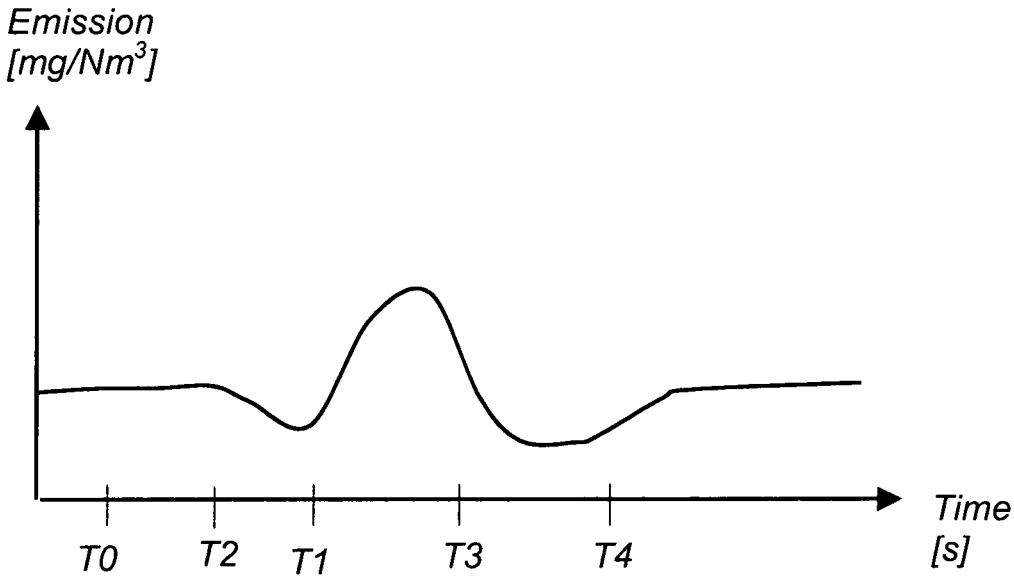
FIG. 4*b* is a schematic diagram illustrating the emission of dust particles produced by operating in accordance with the second method of the present invention.

Referring now to FIG. 4*b* of the drawings, there is illustrated therein a schematic diagram depicting therein the function and the results produced by operation of the second method of the present invention being described hereinafter in more detail. At a time T0, illustrated as such in FIG. 4*b*, the soot-blowing controller 46 operates to send a signal to the rapping controller 34 to the effect that a soot-blowing operation in the boiler 2 is to be initiated in the near future, e.g., in about 15 minutes. In response to the receipt thereby of this signal, the rapping controller 34 operates to cause a check to be effected of the rapping status of each of the three fields 14, 16, 18 of the ESP 6, which are illustrated in FIG. 1. The rapping controller 34 then causes a rapping decision to be issued, according to which some, or all, of the three fields 14, 16, 18 of the ESP 6 are caused to be rapped during the soot-blowing operation. The rapping controller 34 effects the initiation of the rapping events, preferably in accordance with a suitable sequence as has been described hereinbefore, at a first point in time T1. The second point in time T2, i.e., the point in time at which the soot-blowing operation is initiated, occurs before the first point in time T1, as will be best understood with reference to FIG. 4*b*. Furthermore, it will be readily apparent from a reference to FIG. 4*b* that just after the second point in time T2, the latter being the time at which the soot-blowing operation is initiated, the emission of dust particles decreases, the reason for this possibly being the fact that the resistivity of the dust particles is decreased, which is caused by the water vapour that emanates from the soot-blowing lances 42. When the rapping events are initiated at the first point in time T1, the emission of dust particles increases as a result of such rapping events. However, the increase in the emission of dust particles during these rapping events, i.e., after the first point in time T1, is comparatively small due to the fact that the rapping events are initiated during the soot-blowing operation, thereby resulting in an increased removal efficiency, possibly due to a decreased resistivity. The rapping events are completed at the time T3, which results in a decreased amount of emissions of dust particles. At a time T4, which occurs after the time T3, the soot-blowing operation is completed. As will be best understood with reference to FIG. 4*b*, the emission of dust particles increases after the time T4. This is because the moisture content of the flue gas decreases back to normal thereby resulting in the resistivity of the dust being increased. Hence, by controlling the rapping events in accordance with this second method of the present invention such that the rapping events occur during the soot-blowing operation, the emission of dust particles produced by these rapping events is reduced, possibly due to the fact that the moisture content of the flue gas is increased during the soot-blowing operation, with the result that the resistivity of the dust is reduced, and thereby concomitantly improving the operating conditions under which the ESP 6 functions.

Figure 4C:
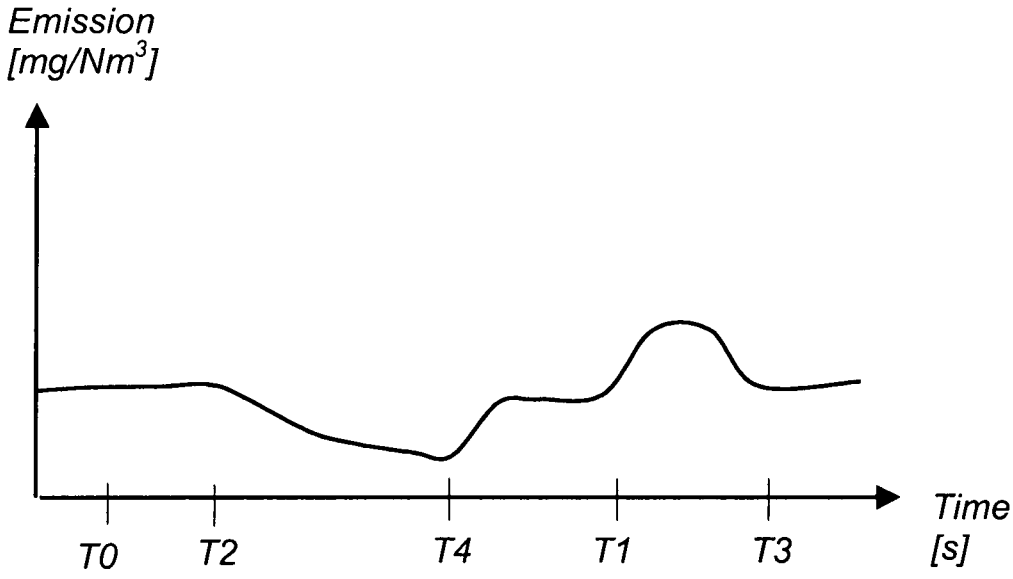
FIG. 4*c* is a schematic diagram illustrating the emission of dust particles produced by operating in accordance with an alternative second method of the present invention.

In FIG. 4*c* of the drawings, there is illustrated an alternative embodiment of the second method of the present invention, to which reference has been had hereinbefore in connection with the discussion with regard to FIG. 4*a* of the drawings. In accordance with this alternative embodiment of the second method of the present invention, the rapping events are initiated at a first point in time T1, which occurs after the time T4 at which the soot-blowing operation is completed after having been previously initiated at a second point in time T2. The times T0 and T3 have a similar meaning with reference to FIG. 4*c* as described hereinbefore in connection with the discussion with regard to FIG. 4*b*. As will be readily understood with reference to FIG. 4*c*, the emission of dust particles decreases during the time span beginning at time T2 and ending at time T4, possibly as a consequence of the decreased resistivity of the dust. During the time period beginning at time T2 and ending at time T4, the dust particles already present on the collecting electrode plates 10 of the ESP 6 become efficiently packed, possibly due to the decreased resistivity thereof. Hence, when the rapping events are initiated at said first point in time T1, which preferably occurs 0-5 minutes after completion of the soot-blowing operation, i.e., occurring 0-5 minutes after time T4, the dust particles will separate from the collecting electrode plates 10 in the form of comparatively dense cakes, thereby resulting in a decrease in the emission of dust particles caused by said rapping events.

It will be appreciated that it would also be possible, without departing from the essence of the present invention, as a further embodiment of this second method of the present invention, to have the rapping events executed partly during the soot-blowing operation and partly after the soot-blowing operation has been completed.

To this end, in accordance with this second method of the present invention, to which reference is made in connection with the discussions of FIG. 4*a*, FIG. 4*b*, and FIG. 4*c* of the drawings, and which preferably is utilized with high resistivity dusts, the first point in time T1, the latter being the point in time at which the rapping events are initiated, occurs after the second point in time T2, the latter being the point in time at which the soot-blowing operation is initiated. The first point in time T1 should, preferably, occur no more than maximum 60 minutes, more preferably maximum 10 minutes, and most preferably maximum 5 minutes, after the time T4 at which the soot-blowing operation has been completed, because otherwise it will not be possible to make use of the positive effects of the reduced resistivity of the dust during the soot-blowing operation.

It will be appreciated that without departing from the essence of the present invention, numerous variants of the embodiments of the present invention, which have been described above, are possible within the scope of the appended claims.

Hereinbefore it has been described that a soot-blowing operation is performed in the boiler, the latter being located upstream of the ESP with respect to the flow direction of the flue gas. It will be appreciated that soot-blowing operations could equally well be performed in other equipment, such as economizers, gas-gas heat exchangers, etc., which are also located upstream of the ESP, without departing from the essence of the present invention. The economizer may, for instance, be operative for purposes of increasing the energy efficiency of the power plant. Also, the gas-gas heat exchanger may, for instance, be operative for purposes of increasing the temperature of inlet combustion air through a heat exchange between the inlet combustion air and the outlet flue gas, in a manner well known in the art. By way of exemplification and not limitation in this regard, the gas-gas heat exchanger could take the form of a Ljungström® regenerative heat exchanger, which is commercially available from the Air Preheater Division of Alstom Power Inc. of Wellsville, N.Y., USA and an early version thereof comprises the subject matter of U.S. Pat. No. 1,522,825. Also for such other types of equipment it is advantageous to cause a signal to be sent to the rapping controller to the effect that as the soot-blowing operation is about to be initiated, the rapping controller is capable of being made to take a rapping decision, which in turn is operative to prepare the ESP for the increase in the concentration of dust particles that will be forthcoming thereto, as a result of the soot-blowing operation performed with respect to such other upstream equipment.

In some cases several different types of rapping events are utilized for cleaning the collecting electrode plates 10 of the ESP 6 described hereinbefore with reference to FIG. 1. For example, it is possible to occasionally perform a so-called power down rapping, by which is meant that the power source 12 of a field, e.g., the first field 14, is shut down during a part of the rapping event of that field 14, or even during the entire rapping event of that field 14. A power down rapping event results in a more efficient cleaning of the collecting electrode plates 10 of the field 14 in question, since there is no electric force keeping the dust particles stuck to the collecting electrode plates 10 during the rapping event. However, a power down rapping event also causes a significantly increased emission of dust particles, compared to a normal rapping event. For example, every $4^{th}$ or every $5^{th}$ rapping event could be of the power down rapping event type, while the other rapping events could be normal rapping events, during which the power source 12 is still active. For some types of dusts, it is advantageous to perform a power down rapping event as the last rapping event before a soot-blowing operation, in accordance with the principles described hereinbefore with reference to FIG. 3*b*, such that the power down rapping event is completed before the soot-blowing operation is initiated, since the collecting electrode plates will be as clean as possible, and have maximum capacity of collecting dust, when the soot-blowing operation is initiated. On the other hand, performing a power down rapping event partly during the soot-blowing operation, in accordance with the principles illustrated hereinbefore with reference to FIG. 3*c*, is normally not suitable, since the power down rapping event generates an increased emission of dust particles, which adds to the dust particles generated by the soot-blowing operation. However, for high resistivity dusts, having a resistivity of more than 1*10E10 ohm*cm, it may be beneficial to control the power down rapping event to occur in conjunction with a soot-blowing operation, to benefit from the enhanced dust removal efficiency occurring during such soot-blowing operation for such high resistivity dusts.

It will be appreciated that in case soot-blowing operations are executed in several different types of equipment that are located upstream of the ESP, the effect of such soot-blowing operations may be different depending on what specific type of soot-blowing operation is being performed on such different types of equipment. For instance, a soot-blowing operation performed in the boiler 2 may result in both a large amount of dust particles being produced as well as a high moisture content being present in the flue gas, while a soot-blowing operation performed in connection with a gas-gas heat exchanger located downstream of the boiler may result in a significantly lesser amount of dust particles being produced, but with still a high moisture content being present in the flue gas. Another possibility is that soot-blowing operations in the boiler could be performed to differing extents. For instance, a full soot-blowing operation and a reduced soot-blowing operation could be performed in the boiler in an alternating manner, with the reduced soot-blowing operation generating a lesser amount of dust particles and being of a shorter duration than a full soot-blowing operation. To account for such different effects of different types of soot-blowing operations, the signal sent to the rapping controller 34 from the soot-blowing controller 46 prior to initiating a soot-blowing operation could also be made to include information regarding the type of soot-blowing that is to be performed. As such, the rapping controller 34 could take such information regarding the type of soot-blowing operation to be performed, which is contained in the signal that is received thereby from the soot-blowing controller 46, into account when determining which, if any, of the fields 14, 16, 18 of the ESP 6 need to be rapped.

Hereinbefore it has been described, with reference to FIGS. 3*a*-3*c*, that rapping events may be controlled to be initiated before a soot-blowing operation is initiated. Furthermore, it has been described, with reference to FIGS. 4*a*-4*c*, that rapping events may be controlled to occur during a soot-blowing operation, or just after a soot-blowing operation, in particular for high resistivity dusts. A further option, in accordance with a further embodiment of the present invention, is to control the rapping events of an ESP in a manner which hinders a rapping event from being initiated during, or just after, a soot-blowing operation of an upstream device, such as a boiler. Thus, said further option provides a further possibility of avoiding the problematic "double-peak" illustrated hereinbefore with reference to FIG. 2. Hence, in accordance with this further option, if a soot-blowing controller is about to initiate a soot-blowing operation at a time T2 in a boiler, it may send a signal to a rapping controller, controlling the rapping of a downstream ESP, to the effect that no rapping event may be initiated until a second signal is sent to the effect that the soot-blowing operation has been completed. The rapping controller is, thereby, not allowed to initiate a rapping event at a time T1 until it has received a signal from the soot-blowing controller to the effect that the soot-blowing operation has been completed. Thus, it may be avoided that the increased emission of dust particles caused by soot-blowing and rapping, respectively, coincide. This further option may be applied to one or more of the fields of the ESP. In particular for a last field of the ESP, such last field normally being subject to rapping events rather seldom, such as once per day, it would be very unsuitable if a rapping event coincided with a soot-blowing operation.

The various methods described above can be implemented using hardware (e.g., as a circuit, a digital signal processor chip, an application specific integrated circuit, or the like). The various methods can also be implemented using a computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The various methods can also be implemented using computer program code transmitted over some transmission medium, such as over electrical wiring or cabling, through fibre optics, or via electromagnetic radiation, wherein, when the computer program code is loaded into and executed by a computer, the computer becomes an apparatus for practicing the invention.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is:

1. A method of controlling the operation of an electrostatic precipitator comprising:

effecting sending of a signal that a soot-blowing operation is about to be initiated in an upstream device to a controller operative for controlling a rapping of an electrostatic precipitator to cause a rapping decision to be made by said controller, based on receipt thereby of said signal, said rapping decision including establishment of a first point in time (T1) for initiating a rapping event with respect to the electrostatic precipitator, said first point in time (T1) is correlated to a second point in time (T2), which is a time at which the soot-blowing operation of said upstream device is initiated.

2. A method according to claim 1, wherein said first point in time (T1) is a time which occurs before said second point in time (T2), such that the electrostatic precipitator (6) will be at least partially cleansed of dust particles before the soot-blowing operation of said upstream equipment (2) is initiated.

3. A method according to claim 1, wherein the relationship of said first point in time (T1) to said second point in time (T2)

is such that the performance of the rapping event with respect to the electrostatic precipitator is at least 50% completed before the soot-blowing operation of said upstream device is initiated.

4. A method according to claim 1, wherein said soot-blowing operation comprises utilizing at least one soot-blowing substance selected from among steam and water, with said first point in time (T1) established to occur after said second point in time (T2), such that operation of the electrostatic precipitator is enhanced by virtue of a process gas having an increased moisture content from said soot-blowing substance.

5. A method according to claim 1, wherein said soot-blowing operation comprises utilizing at least one soot-blowing substance selected from among steam and water, with said first point in time (T1) established to occur a maximum of 60 minutes after said second point in time (T2), such that operation of the electrostatic precipitator is enhanced by virtue of a process gas having an increased moisture content from said soot-blowing substance.

6. A method according to claim 1, wherein said soot-blowing operation comprises utilizing at least one soot-blowing substance selected from among steam and water, with said first point in time (T1) established to occur during the soot-blowing operation, such that operation of the electrostatic precipitator is enhanced by virtue of a process gas having an increased moisture content from said soot-blowing substance.

7. A method according to claim 1, wherein said first point in time (T1) is established to occur 0-5 minutes after completion of the soot-blowing operation.

8. A method according to claim 1, wherein said controller causes a signal to be sent to a soot-blowing controller regarding the rapping status of the electrostatic precipitator, and said soot-blowing controller causes said second point in time (T2) to be established relative to said rapping status.

9. A method according to claim 1, wherein said signal also provides information regarding type of soot-blowing operation about to be initiated.

10. A device for controlling the operation of an electrostatic precipitator comprising:

a controller operative for controlling performance of a rapping event with respect to the electrostatic precipitator, for receiving a signal that a soot-blowing operation is about to be initiated in an upstream device, and for causing a rapping decision based on receipt of said signal, with said rapping decision including establishment of a first point in time (T1) for initiating performance of a rapping event, correlated to a second point in time (T2), which is a time at which the soot-blowing operation of said upstream device is initiated.

11. A device according to claim 10, wherein said controller is operative for initiating performance of a rapping event at said first point in time (T1), which occurs before said second point in time (T2), such that the electrostatic precipitator is at least partially cleansed of dust particles before the soot-blowing operation of said upstream device is initiated.

12. A device according to claim 10, wherein said controller is operative for establishing said first point in time (T1) to occur after said second point in time (T2), such that operation of the electrostatic precipitator is enhanced by process gas having an increased moisture content due to use of a soot-blowing substance in said soot-blowing operation.

* * * * *